US009387374B2

(12) United States Patent
Golden et al.

(10) Patent No.: US 9,387,374 B2
(45) Date of Patent: Jul. 12, 2016

(54) GOLF CLUB IRON SET PRODUCING FLIGHT HAVING CONSISTENT ANGLE OF DESCENT

(71) Applicant: Acushnet Company, Fairhaven, MA (US)

(72) Inventors: Charles E. Golden, Encinitas, CA (US); Jeffrey A. Harmet, Encinitas, CA (US); Daniel Stone, Long Beach, CA (US); Richard M. Nelson, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 11 days.

(21) Appl. No.: 14/505,707

(22) Filed: Oct. 3, 2014

(65) Prior Publication Data

US 2015/0038251 A1 Feb. 5, 2015

Related U.S. Application Data

(63) Continuation of application No. 13/608,102, filed on Sep. 10, 2012, now abandoned.

(51) Int. Cl.
*A63B 53/00* (2015.01)
*A63B 53/04* (2015.01)

(52) U.S. Cl.
CPC ..... *A63B 53/047* (2013.01); *A63B 2053/005* (2013.01); *A63B 2053/0408* (2013.01)

(58) Field of Classification Search
CPC ..... A63B 53/047; A63B 2053/005; A63B 2053/0408
See application file for complete search history.

(56) References Cited

U.S. PATENT DOCUMENTS 4,762,322 A * 8/1988 Molitor ..... A63B 53/04 273/DIG. 8
4,802,672 A * 2/1989 Long ..... A63B 53/00 473/291
5,388,826 A * 2/1995 Sherwood ..... A63B 53/04 473/290
5,480,145 A * 1/1996 Sherwood ..... A63B 53/04 473/290
5,795,240 A * 8/1998 Chappell ..... A63B 53/02 473/291
6,093,112 A * 7/2000 Peters ..... A63B 53/00 473/291
6,290,607 B1 * 9/2001 Gilbert ..... A63B 53/04 473/291
6,482,104 B1 11/2002 Gilbert
6,592,469 B2 * 7/2003 Gilbert ..... A63B 53/04 473/291
6,719,641 B2 * 4/2004 Dabbs ..... A63B 53/04 473/291
6,780,123 B2 * 8/2004 Hasebe ..... A63B 53/04 473/291
6,860,819 B2 3/2005 Gilbert
6,916,251 B2 * 7/2005 Shiraishi ..... A63B 53/00 473/289
7,186,187 B2 * 3/2007 Gilbert ..... A63B 53/047 473/290
7,699,716 B2 4/2010 Burnett et al.
8,235,832 B2 8/2012 Burnett et al.
8,376,875 B2 * 2/2013 Nakamura ..... A63B 53/10 473/319
8,444,509 B2 * 5/2013 Swartz ..... A63B 24/0003 473/221
8,696,497 B2 * 4/2014 Voges ..... A63B 69/36 473/222
2004/0087384 A1 * 5/2004 Sosin ..... A63B 53/00 473/289
2007/0042832 A1 * 2/2007 Hjaltason ..... A63B 53/02 473/314
2014/0073447 A1 3/2014 Golden et al.

* cited by examiner

*Primary Examiner* — Stephen Blau

(57) ABSTRACT

In accordance with the present invention, a set of golf club heads is disclosed. The set includes golf club heads with peripheral weights. The dimensions and configuration of at least the peripheral weights are changed from club-to-club along the set so that the center of gravity rises from the long irons to the short irons. By raising the center of gravity from the long irons to the short irons, a golfer will see a peak trajectory height along a line for each club head that is substantially more consistent along that line throughout the set than prior art clubs provide.

16 Claims, 4 Drawing Sheets

GOLF CLUB IRON SET PRODUCING FLIGHT HAVING CONSISTENT ANGLE OF DESCENT

CROSS-REFERENCE TO RELATED APPLICATIONS

The present application is a continuation of U.S. patent application Ser. No. 13/608,102, to Golden et al., filed on Sep. 10, 2012, currently pending, the disclosure of which is hereby incorporated by reference in its entirety.

TECHNICAL FIELD OF THE INVENTION

The present invention generally relates to sets of iron golf clubs, and more particularly, to sets of iron golf clubs that provide a consistent ball flight peak height and consistent ball flight angle of descent.

BACKGROUND OF THE INVENTION

In conventional sets of "iron" golf clubs, each club includes a shaft with a club head attached to one end and a grip attached to the other end. The club head includes a face for striking a golf ball. The angle between the face and a vertical plane is called "loft." In general, the greater the loft is of the golf club in a set, the greater the launch angle and the less distance the golf ball is hit.

A set of irons generally includes irons that are designated number 3 through number 9 and a pitching wedge. The iron set is generally complimented by a series of wedges, such as a pitching wedge, a lob wedge, a gap wedge, and/or a sand wedge. Sets can also include a 1 iron and a 2 iron, but these clubs are generally sold separate from the set. Each iron has a shaft length that usually decreases through the set as the loft for each club head increases, from the long irons to the short irons. The length of the club, along with the club head loft and center of gravity impart various performance characteristics to the ball's launch conditions upon impact. The initial trajectory of the ball generally extends between the impact point and the apex or peak of the trajectory. In general, the ball's trajectory for long irons, like the 3 iron, is a more penetrating, lower trajectory due to the lower launch angle and the increased ball speed off of the club. Short irons, like the 8 iron or pitching wedge, produce a trajectory that is substantially steeper and less penetrating than the trajectory of balls struck by long irons. The highest point of the long iron's ball flight is lower than the highest point for the short iron's ball flight. The mid irons, such as the 5 iron, produce an initial trajectory that is between those exhibited by balls hit with the long and short irons.

One of the major problems for players is that the lower launch angle of the golf balls hit with long irons leads to a low angle of descent. Because the ultimate peak height is less and the ball is traveling at a faster pace, the angle of descent can be very low. Thus, the ball can hit near a targeted area and then continue to roll for an extended distance. With short irons, players are generally able to hit the ball close to the intended target and the ball will remain close to the point of impact after it hits the ground. It would be desirable to have all the club heads in a set produce a relatively consistent peak height and, particularly, a more consistent angle of descent through the set. This would allow golfers to improve their performance and confidence.

SUMMARY OF THE INVENTION

In accordance with the present invention, a set of golf clubs is disclosed. The set includes at least first, second and third golf clubs that are comprised of a club head attached to a shaft and grip. An improvement is that the set is configured such that the angle of descent of a golf ball hit by each of the clubs in the set is substantially more constant than in the past. Furthermore, the set is preferably configured such that the maximum height of the ball trajectory for each of the clubs is greater than about 30 yards and is relatively constant through the set.

Within the set, the first, second and third golf club heads each comprise a heel, a toe, an upper surface, a lower surface, a hosel and a front face for striking the golf ball. The first club is a long iron, comprising a first loft angle ($LA_1$) of between about 15 and 25 degrees and generally has a longer shaft. The second golf club is a mid iron comprising a second loft angle ($LA_2$) of between about 26 and 36 degrees. The third golf club is a short iron comprising a third loft angle ($LA_3$) of between about 37 and 47 degrees. In most circumstances, the long irons include the 2-4 irons within a set, the mid irons include the 5-7 irons and the short irons include the 8-Pitching Wedge.

After studying many PGA Tour players, the inventors discovered that the maximum height of each club in a set drastically decreased for long irons and the angle of descent was very low for long irons. According to the data obtained, prior art clubs could be characterized as having a angle of descent (AD) described by a best fit linear equation according to the following formula:

$$AD=m(LA)+z$$

wherein LA is the iron loft angle, $m_{pa}$, is about 0.7 and $z_{pa}$ is about 22 degrees. Thus, a preferred embodiment of the present invention can be characterized by the same equation wherein $m_I$ is less than about 0.5 and $z_I$ is greater than about 30 degrees. More preferably, $m_I$ is between about 0.1 and 0.4 and, most preferably, $m_I$ is between about 0.2 and 0.4. Further, in the preferred set of golf clubs according to the present invention, $z_I$ is between 35 and 45 degrees, and more preferably, $z_I$ is about 35-40 degrees.

Furthermore, in a preferred embodiment of the inventive set of irons, the maximum trajectory height for the first, second and third golf clubs are all between about 30 and 35 yards. The distance at which each club obtains the maximum height varies through the set, but is inversely proportional to the iron loft angle. In a most preferred set, the maximum trajectory height for the first, second and third golf clubs are substantially constant.

Still further, in a preferred embodiment of the inventive set of irons, the first center of gravity height for a long iron is less than the second center of gravity height of the mid iron by at least 0.1 inch and the second center of gravity height is less than the third center of gravity height of the short iron by at least 0.1 inch. Preferably, the lower surface of the first golf club is formed from a material have a specific gravity of greater than 10 g/c and/or a portion of the hosel of the first golf club is comprised of a material having a specific gravity of less than 7 g/cc.

Within a set of golf club irons according to the present invention, each of the first, second and third golf clubs has a shaft axis and a distance from the center of gravity of each club to the shaft axis. In one embodiment, this distance is approximately constant throughout the set. In another embodiment, this distance is progressive throughout the set such that the distance is inversely proportional to the loft angle such that as loft angle increases, the distance between the center of gravity and the shaft axis decreases. Also, the first golf club has a first offset, the second golf club has a second offset and third golf club has a third offset and, preferably, the first offset is less than 0.15 inch and greater than the second offset and the second offset is greater than the third offset. Even more preferably, the first offset is less than about 0.14, inches.

DETAILED DESCRIPTION OF THE PREFERRED EMBODIMENTS

Figure 1:
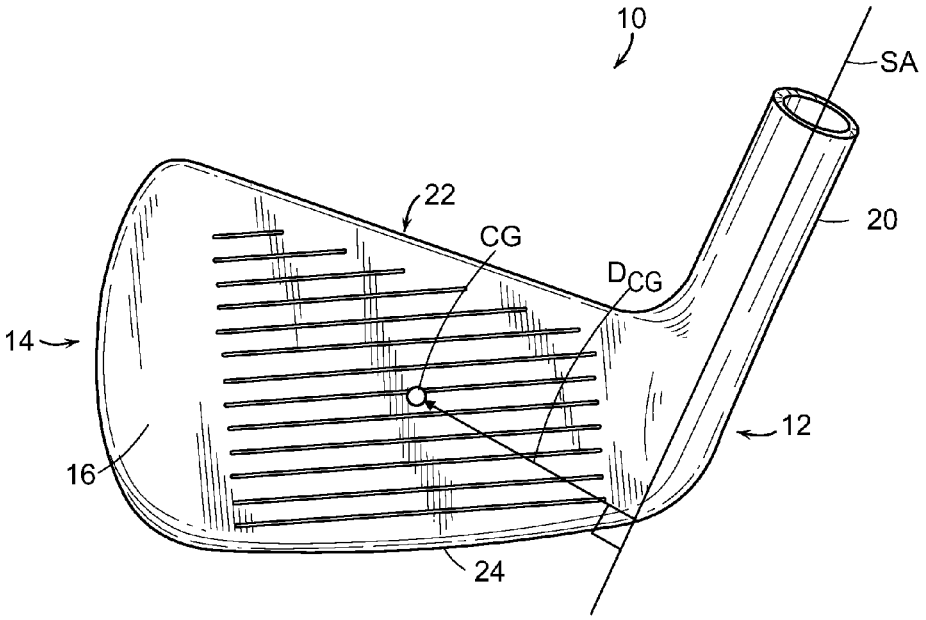
FIG. 1 is a front view of a golf club head of the present invention.

As illustrated in the accompanying drawings and discussed in detail below, the present invention is directed to a set of iron-type golf clubs, wherein the clubs create a ball flight that ends in a more consistent angle of descent AD throughout the set. Referring to FIG. 1, each club in a set includes a club head 10 attached to a shaft (not shown) in any manner known in the art, at a hosel 20.

Club head 10 includes, generally, the hosel 20, a striking or hitting face 16 and a back portion that can be cavity backed or muscle backed as is well known in the art. The club head also has a heel 12, a toe 14, a top line 22 and a sole 24. As is well know in the art, the club head 10 and hosel 20 are designed such that the club has a center of gravity CG that is located between the toe 14 and heel 12.

Figure 2:
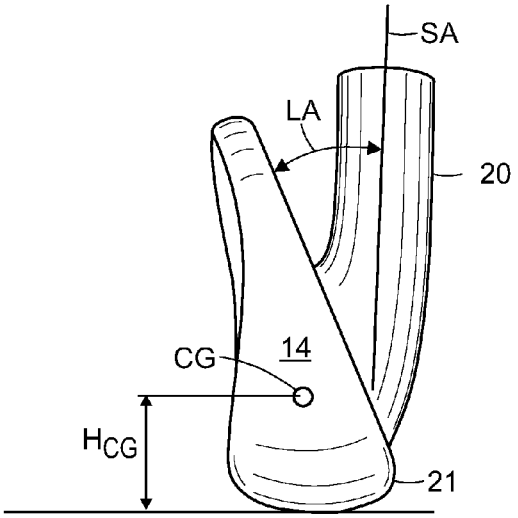
FIG. 2 is side view of the golf club head of FIG. 1.

As shown in FIG. 2, the club head is attached to the shaft at an angle $\alpha$, which is known as the club head loft angle LA. In typical sets of golf clubs, the area of hitting face 16, the heel-to-toe length of club head 10, loft angle LA, and offset vary from club to club within the set. For example, long irons, such as a 2-, 3- or 4-iron using conventional numbering, typically include relatively long shafts, relatively small areas for hitting face, and relatively low loft angles. Similarly, short irons, such as an 8- or 9-iron using conventional numbering, typically include relatively short shafts, relatively large areas for hitting face, and relatively high loft angles. In one embodiment of the present invention, these parameters are particularly chosen to maximize the performance of each club for its intended use in terms of carry distance and optimized to achieve the desired angle of descent AD through the set.

In accordance with an aspect of the present invention, the inventive iron golf clubs are designed to have substantially the same carry distance as conventional iron golf clubs. Each inventive iron golf club is designed to hit golf balls a prescribed distance in the air, and to stop on the green or fairway in a predictable manner.

Using actual golf ball flight data obtained using a TrackMan™, the carry distance, maximum ball height and angle of descent can be measured. First, 2011 Titleist Pro V1x golf balls are hit using a Golf Labs™ hitting machine set up to strike the golf ball at typical PGA Tour speeds. For example, and for purposes of this application, a 3-iron is set up to hit the ball at a club head speed of 97 mph and an attack angle of −5 degrees, a 5-iron is set up to hit the ball at a club head speed of 95 mph and an attack angle of −6 degrees and an 8-iron is set up to hit the ball at a club head speed of 92 mph and an attack angle of −7.5 degrees. The remainder of the clubs within the set can be tested by interpolating and extrapolating from these points. After the ball is hit, the TrackMan™ measures the flight of the ball, such that the ball height and angle of descent can be obtained. Next, adjustments are made to the irons in the set to adjust the flight parameters to reach the target performance. For example, if the data suggest that the maximum ball height for a particular club is lower than the target height, then adjustments are made to the club to increase the ball flight height, such as increasing launch angle or ball spin. Potential adjustments to the irons include, but are not limited to, the following factors and combinations thereof:

i. increasing/decreasing shaft length to adjust club head speed and initial ball speed;

ii. increasing/decreasing static loft angle to adjust launch angle and backspin;

iii. adjusting the flexing characteristics of the shaft to adjust club head speed, initial ball speed and spin;

iv. adjusting the location of the center of gravity, CG, of the club head, including lowering the CG and/or moving the CG further aft of the hitting face, to adjust trajectory of the ball; and v. varying groove geometry and/or the surface roughness to adjust the amount of ball spin.

U.S. Pat. No. 7,699,716 outlines specifically what the PGA Tour speeds and launch conditions are in the specification and the entire specification provides a detailed discussion of club design characteristics that can be manipulated to achieve particular distances and flight characteristics through a set. In other words, while the '716 patent teaches away from designing a set of irons such that the flight height remains more consistent in a set, as evidenced by FIG. 10, or to adjust the angle of descent to be substantially constant at all, it does provide a detailed description of how to manipulate individual clubs through the set to influence parameters such as ball speed, launch angle and back spin. Thus, the '716 patent is hereby incorporated by reference in its entirety for these reasons.

Referring to FIG. 2, a number of dimensions of the club head will be discussed. The golf club head 10 includes a loft angle LA which is the angle between the front face 16 and a vertical plane perpendicular to the ground. At the address position, the shaft axis SA coincides with the vertical plane. The center of gravity CG is located a height $H_{CG}$, from the horizontal plane of the ground in the address position. The center of gravity CG can also be manipulated in the horizontal direction, either toward or away from the leading edge 21. In some instances, it can also be desirable to move the center of gravity CG toward or away from the toe to make the club head harder or easier to close, respectively, during the swing. By moving the center of gravity toward the heel 12, for example, the moment of inertia of the iron about the shaft axis SA is reduced, making the club head easier to close.

Figure 3:
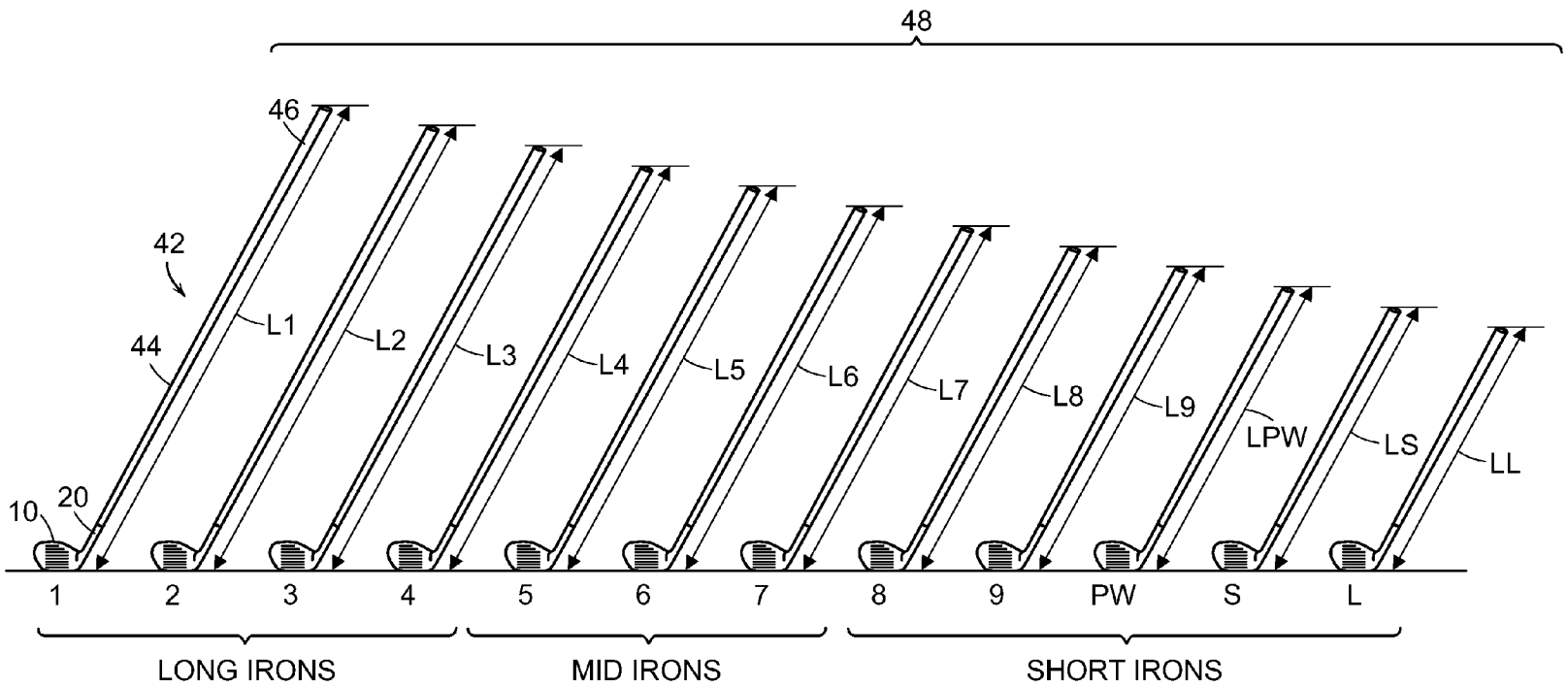
FIG. 3 is a front view of a set of golf clubs of the present invention.

Referring to FIG. 3, the golf club head 10 is shown incorporated into a golf club 42, which is a 1-iron. The golf club 42 includes a shaft 44 and a grip 46. The lower end of the shaft 44 is attached to the club head 10 at the hosel 20. The golf club 42 also has the grip 46 attached to the shaft 44 at the upper end. The 1 iron has a length designated L1. Each of the remaining clubs has a length L2-LL. The long-irons are designated by the 1-iron through the 4-iron, the mid-irons are the 5-iron through the 7-iron and the short-irons are the 8-iron through the lob wedge (LW). As set forth above, this set depicted in FIG. 3 includes more than a normal set. Thus, a set of irons as set forth in this application does not need to contain all of these clubs as long as the set includes one long iron, one mid-iron and one short iron. The short irons can include a series of wedges, comprising the pitching wedge PW, the sand wedge SW and the lob wedge LW. FIG. 3 illustrates that from the long irons to the short irons in a set of clubs 48, the length of the clubs generally decreases from the long irons to the short irons. The lie angle between clubs can also vary.

In the first embodiment, the club heads are cast so that the club heads are integral and formed of one material. The club heads can be cast or forged from a material such as 431 Stainless Steel or other materials including alloys well known by those of ordinary skill in the art of making clubs. The clubs can also be formed in one or more parts that are joined by various methods, for example but not limited to welded, silver soldered, brazed, or mechanically fastened with fasteners.

EXAMPLE

These and other aspects of the present invention may be more fully understood with reference to the following non-limiting example which is merely illustrative of a preferred embodiment of the present invention set of golf clubs, and is not to be construed as limiting the invention, the scope of which is defined by the appended claims.

Tables I and II provides exemplary, non-limiting dimensions for the various measurements of clubs discussed in reference to FIG. 3. It is fully intended that the dimensions set forth below can be adjusted as discussed above. For example, a 3 iron according to the invention can be made with a loft of 20-22 degrees to adjust the angle of descent and remain within the scope of the present invention.

TABLE I

| Club number | Loft (degrees) | Length (inches) | Cg Vertical (inches) |
|---|---|---|---|
| 2 iron | 18 | 39.5 | 0.68-0.73 |
| 3 iron | 21 | 39 | 0.7-0.75 |
| 4 iron | 24 | 38.5 | 0.73-0.78 |
| 5 iron | 27 | 38 | 0.8-0.85 |
| 6 iron | 31 | 37.5 | 0.82-0.87 |
| 7 iron | 35 | 37 | 0.84-0.9 |
| 8 iron | 39 | 36.5 | 0.9-0.95 |
| 9 iron | 43 | 36 | 0.93-0.98 |
| Pitching Wedge | 47 | 35.75 | 0.95-1.0 |

TABLE II

| Club number | Lie (degrees) | Offset (inches) | Swingweight |
|---|---|---|---|
| 2 iron | 60 | 0.125-0.15 | D1-D3 |
| 3 iron | 60 | 0.125-0.14 | D1-D3 |
| 4 iron | 61 | 0.12-0.13 | D1-D3 |
| 5 iron | 62 | 0.115-0.12 | D1-D3 |
| 6 iron | 62.5 | 0.11-0.12 | D1-D3 |
| 7 iron | 63 | 0.1-0.11 | D1-D3 |
| 8 iron | 63.5 | 0.09-0.1 | D1-D3 |
| 9 iron | 64 | 0.08-0.09 | D1-D3 |
| Pitching Wedge | 64 | 0.075-0.08 | D1-D3 |

Figure 4:
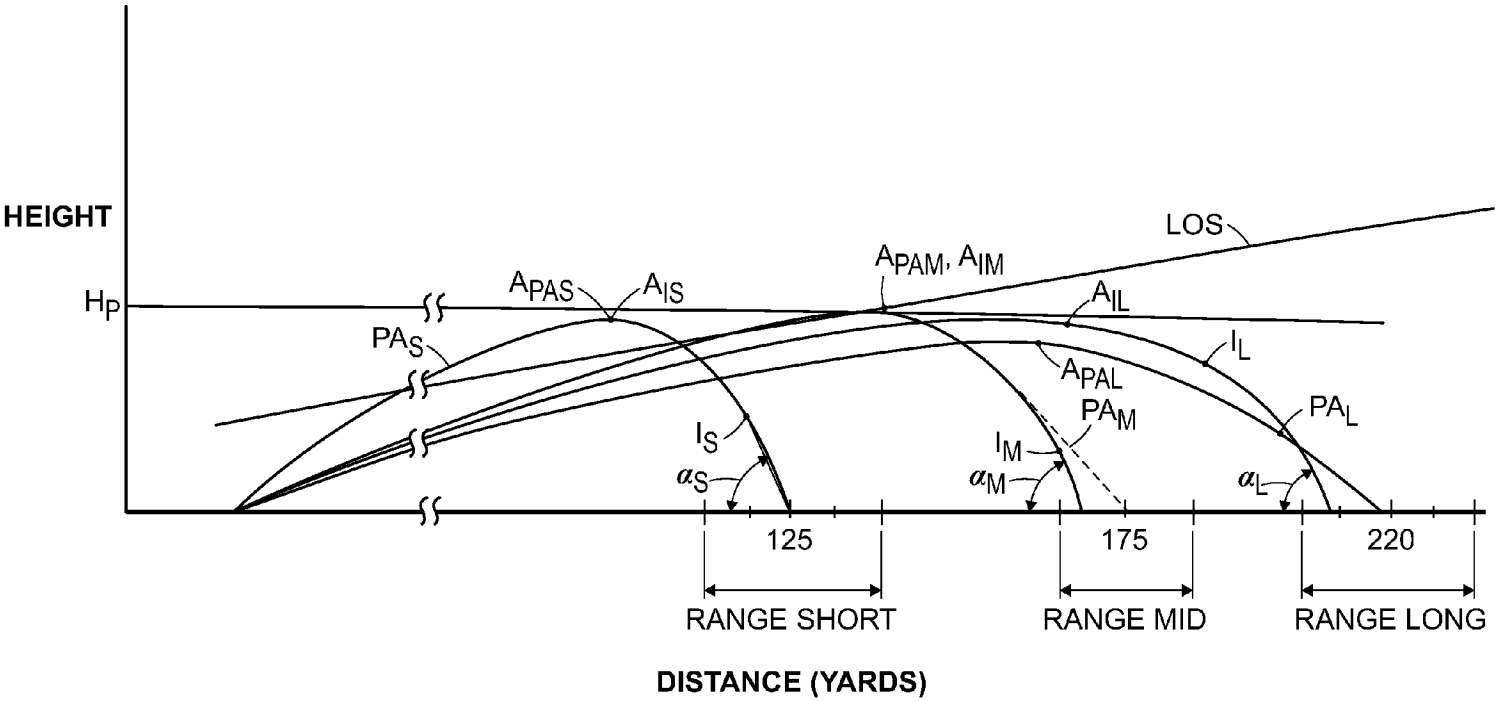
FIG. 4 is a graph showing ball flight trajectories achieved with various prior art clubs as compared to ball flight trajectories achieved with various clubs of the present invention from the set shown in FIG. 3.

Referring to FIG. 4, ball flight trajectories of prior art clubs are compared to the ball flight trajectories of clubs according to the present invention. FIG. 4 is a graph of Height versus Distance. The line LOS represents the line of sight of a golfer viewing each ball in flight. The ball flight trajectories labeled $PA_S$, $PA_M$, $PA_L$ represent the ball flight trajectories exhibited by balls hit by a set comprised of a prior art short-iron, a mid-iron and a long-iron, respectively. The ball flight trajectories labeled $I_S$, $I_M$, $I_L$ represents the ball flight trajectories exhibited by balls hit by a set of irons comprised of a short-iron, a mid-iron and a long-iron, respectively, formed according to the present invention. Each prior art ball trajectory includes an apex or peak trajectory height of the flight labeled $A_{PAS}$, $A_{PAM}$, and $A_{PAL}$ for each of the short-, mid- and long-irons. Each inventive ball trajectory includes an apex or highest point of the flight labeled $A_{IS}$, $A_{IM}$, and $A_{IL}$ for each of the short-, mid- and long-irons, respectively. As evidenced by the graph, $A_{IS}$, $A_{IM}$, and $A_{IL}$ are relatively similar at a preferred height, $H_P$, of approximately 30 to 35 yards. More important, the angle of descent AD for balls for the balls hit with the inventive clubs should be substantially similar and according to the following equation:

$$AD=m(LA)+z$$

Where m is less than 0.5 and, preferably, between 0.1 and 0.4. Most preferably, m is between 0.2 and 0.4. z is greater than 30 degrees and preferably between 35 and 45 degrees. Most preferably, z is about 35-40 degrees. Thus, the angle of descent will be greater for the short irons that have higher loft angles. It is also understood that the short irons impart greater spin on the golf ball than long irons. Thus, the ground roll for short irons and long irons according to the present invention will differ significantly.

As set forth in Table I, the center of gravity locations within the set should be set to assist with the creation of the preferred flight paths. Option can include, for example, lowering the center of gravity of the long irons by forming the lower surface, or sole, of the long irons from a material have a specific gravity of greater than 10 g/cc such as tungsten or a tungsten alloy. Additionally, the hosel of the long irons can be comprised of a material having a specific gravity of less than 7 g/cc such as titanium, aluminum or alloys thereof. Conversely, high specific gravity materials may be employed within the topline portion of the short irons to raise the center of gravity. Another way to accomplish the progression of the center of gravity through the set is to employ a progressive face insert. Referring to FIG. 1, the face 16 can be made of different materials throughout the set. For example, the long irons could employ a titanium alloy insert such as Ti 6-4, which has a specific gravity of 4.4 g/cc and the mid-irons and short irons could employ steel faces having a specific gravity of about 7.9 g/cc. By using a higher strength steel in the mid-irons, such as 17-4 stainless steel, the faces can be designed thin to reduce weight and by using a softer steel, such as 431 stainless steel, in the short irons, the feel of the short irons can be improved.

Another aspect of the preferred embodiment is to have a consistent feel within the set. Thus, the swingweights of the irons may be constant through the set. Furthermore, the distance from the center of gravity to the shaft axis can be approximately constant through the set or progress through the set inversely to the loft.

Figure 5:
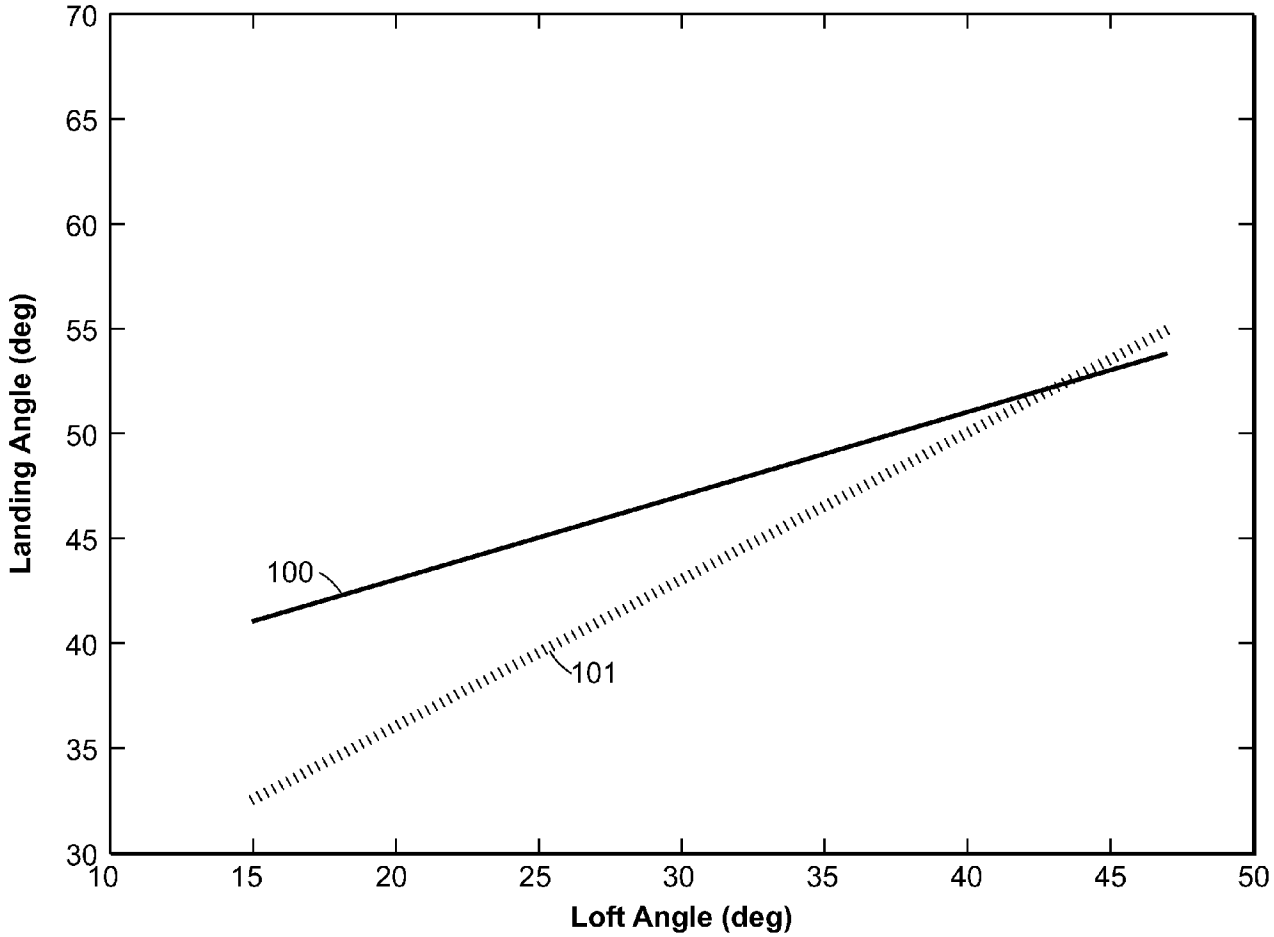
FIG. 5 is a graph showing angle of descent compared to loft angle of a preferred embodiment compared to prior art clubs.

FIG. 5 illustrates the preferred embodiment of the present invention relative to the prior art. In FIG. 5 the solid line 100 represents a set of irons where:

$$AD=m(LA)+z$$

And m is equal to 0.4 and z is equal to 35 degrees compared to the prior art 101. This demonstrates the drastic difference in the angle of descent between the long irons of the present invention and the prior art. For example, the 3 iron according to the embodiment in FIG. 5 has a loft of 21 degrees and an angle of descent of approximately 41 to 42 degrees, whereas the angle of descent for the prior art 3 iron was only about 35 degrees. In fact, the angle of descent in the prior art does not reach 41 to 42 degrees until about the 6 iron.

While it is apparent that the illustrative embodiments of the invention disclosed herein fulfill the objectives stated above, it is appreciated that numerous modifications and other embodiments may be devised by those skilled in the art. The sets of clubs disclosed can include a series of wedges, each with a different loft, such as pitching, lob, gap and sand wedges. The features disclosed to vary the angle of descent, as discussed above, can be used in different combinations. Therefore, it will be understood that the appended claims are intended to cover all modifications and embodiments which would come within the spirit and scope of the present invention.

What is claimed is:

1. A set of golf clubs comprising at least a first golf club, a second golf club, and a third club, wherein the first, second and third golf clubs each comprising a heel, a toe, an upper surface, a lower surface, a hosel and a front face, and the first golf club further comprising a first loft angle ($LA_1$) of between 15 and 25 degrees and a first center of gravity height and a first angle of decent (AD) when hitting a ball, using a hitting machine, at a club head speed of 97 mph and an attack angle of −5 degrees, the second golf club comprising a second loft angle ($LA_2$) of between 26 and 36 degrees and a second center of gravity height that is greater than the first center of gravity height and a second angle of decent (AD) when hitting the ball, using the hitting machine, at a club head speed of 95mph and an attack angle of −6 degrees, and the third golf club comprising a third loft angle ($LA_3$) of between 37 and 47 degrees and a third center of gravity height that is greater than the second center of gravity height and a third angle of decent (AD) when hitting the ball, using the hitting machine, at a club head speed of 92mph and an attack angle of −7.5degrees, wherein the set has a best fit linear equation for the first, second and third angle of descent (AD) according to the following formula:

$$AD=m(LA)+z$$

wherein LA is the iron loft angle, m is less than 0.5 and z is greater than 30 degrees.

2. The set of golf clubs of claim 1, wherein m is between 0.1 and 0.4 and z is between 35 and 45 degrees.

3. The set of golf clubs of claim 1, wherein m is between 0.2 and 0.4 and z is between 35 and 40 degrees.

4. The set of golf clubs of claim 1, wherein z is about 35-40 degrees.

5. The set of golf clubs of claim 1, wherein z is about 40 degrees.

6. The set of golf clubs of claim 1, wherein maximum trajectory height for the first, second and third golf clubs are all between about 30 and 35 yards.

7. The set of golf clubs of claim 6, wherein maximum trajectory height for the first, second and third golf clubs are substantially similar.

8. The set of golf clubs of claim 1, wherein the first center of gravity height is less than the second center of gravity height by at least 0.1 inch and the second center of gravity height is less than the third center of gravity height by at least 0.1 inch.

9. The set of golf clubs of claim 8, wherein the lower surface of the first golf club is formed from a material have a specific gravity of greater than 10 g/cc.

10. The set of golf clubs of claim 9, wherein a portion of the hosel of the first golf club is comprised of a material having a specific gravity of less than 7 g/cc.

11. The set of golf clubs of claim 1, wherein each of the first, second and third golf clubs has a shaft axis and the distance from the center of gravity to the shaft axis is approximately constant.

12. The set of golf clubs of claim 1, wherein each of the first, second and third golf clubs has a shaft axis and the distance from the center of gravity to the shaft axis is inversely proportional to the loft angle.

13. The set of golf club heads of claim 1, wherein the first golf club has a first offset, the second golf club has a second offset and third golf club has a third offset and first offset is less than 0.15 inch and greater than the second offset and the second offset is greater than the third offset.

14. A set of golf clubs comprising at least a first golf club, a second golf club, and a third club, wherein the first, second and third golf clubs each comprising a heel, a toe, an upper surface, a lower surface, a hosel and a front face, and the first golf club further comprising a first loft angle ($LA_1$) of about 21 degrees and a first center of gravity height of about 0.7 to 0.75 inch, a first length of about 39 inches and a first offset of about 0.125 to 0.15 inch, and creating a first angle of decent (AD) when hitting a ball, using a hitting machine, at a club head speed of 97 mph and an attack angle of −5 degrees, the second golf club comprising a second loft angle ($LA_2$) of about 27 degrees and a second center of gravity height of about 0.8 to 0.85 inch, a second length of about 38 inches and a second offset of about 0.115 to 0.12 inch, and creating a second angle of decent (AD) when hitting the ball, using the hitting machine, at a club head speed of 95 mph and an attack angle of −6 degrees, and the third golf club comprising a third loft angle ($LA_3$) of about 39 degrees and a third center of gravity height of about 0.9 to 0.95 inch, a third length of about 36.5 inches and a third offset of about 0.09 to 0.1 inch and creating a third angle of decent (AD) when hitting the ball, using the hitting machine, at a club head speed of 92 mph and an attack angle of −7.5 degrees, wherein the set has a best fit linear equation for the first, second and third angle of descent (AD) according to the following formula:

$$AD=m(LA)+z$$

wherein LA is the iron loft angle, m is less than 0.5 and z is greater than 30 degrees.

15. A set of golf clubs comprising at least a first golf club, a second golf club, and a third club, wherein the first, second and third golf clubs each comprising a heel, a toe, an upper surface, a lower surface, a hosel and a front face, and the first golf club further comprising a first loft angle ($LA_1$) of about 21 degrees and a first center of gravity height ($CGH_l$) of about 0.7 to 0.75 inch and a first angle of decent (AD) when hitting a ball, using a hitting machine, at a club head speed of 97 mph and an attack angle of −5degrees, the second golf club comprising a second loft angle ($LA_2$) of about 27 degrees and a second center of gravity height ($CGH_2$) of about 0.8 to 0.85 inch and a second angle of decent (AD) when hitting the ball, using the hitting machine, at a club head speed of 95 mph and an attack angle of −6degrees, and the third golf club comprising a third loft angle ($LA_3$) of about 39 degrees and a third center of gravity height ($CGH_3$) of about 0.9 to 0.95 inch and a third angle of decent (AD) when hitting the ball, using the hitting machine, at a club head speed of 92 mph and an attack angle of −7.5 degrees, wherein the set has a best fit linear equation for the angle of descent (AD) according to the following formula:

$$AD = m(LA) + z$$

wherein LA is the iron loft angle, m is less than 0.5 and z is greater than 30 degrees; and wherein the difference between $(LA_1)/(CGH_1)$ and $(LA_3)/(CGH_3)$ is between 15 and 11.

16. The set of golf club heads of claim 15, wherein the difference between $(LA_1)/(CGH_1)$ and $(LA_2)/(CGH_2)$ is between 5.8 and 1.8.

* * * * *